United States Patent [19]

Takahashi

[11] 3,994,659

[45] Nov. 30, 1976

[54] APPARATUS FOR FORMIMG CERAMIC HOLLOW WARE WITH SPLIT MOULD

[75] Inventor: Koji Takahashi, Nagoya, Japan

[73] Assignee: Nippon Toki Kabushiki Kaisha, Nagoya, Japan

[22] Filed: Apr. 16, 1976

[21] Appl. No.: 677,839

Related U.S. Application Data

[63] Continuation of Ser. No. 207,741, Dec. 14, 1971, abandoned.

[30] Foreign Application Priority Data

Dec. 21, 1970 Japan ..... 45-114925

[52] U.S. Cl. ..... 425/425; 164/292; 269/156; 279/110; 425/451.9

[51] Int. Cl.[2] ..... B28B 1/02

[58] Field of Search ..... 164/292, 293; 425/425, 425/182, 451.9; 269/156; 279/106, 110

[56] References Cited

UNITED STATES PATENTS 3,353,221 11/1967 Barnett et al. ..... 425/451.9

FOREIGN PATENTS OR APPLICATIONS 118,950 2/1946 Australia ..... 164/293

131,032 3/1951 Sweden ..... 164/293

*Primary Examiner*—Robert D. Baldwin

*Attorney, Agent, or Firm*—Stevens, Davis, Miller & Mosher

[57] ABSTRACT

The upper and lower parts of a split mould are merely superposed together, and an inclined peripheral surface of said upper mould is brought into engagement with claws of a chuck attached to a rotary shaft of forming or moulding machine.

1 Claim, 4 Drawing Figures

INVENTOR

BY

ATTORNEY

INVENTOR

BY

ATTORNEY

APPARATUS FOR FORMIMG CERAMIC HOLLOW WARE WITH SPLIT MOULD

This is a continuation of application Ser. No. 207,741 filed Dec. 14, 1971, now abandoned.

The present invention relates to apparatus for forming a ceramic hollow ware with a split mould. More specifically, the upper one of parts of a mould is simply divided horizontally or vertically without any interlocking mechanism between the parts. It has an inclined surface of a frustum of a cone and the like formed at the outer periphery, and the inclined outer-peripheral surface is held by bringing claws of a chuck of a forming machine into engagement therewith. The invention eliminates disadvantages resulting from the structural complexity of the interlocking mechanism of a split mould such as high cost, less durability and precision, and wastes in time in taking out a formed article and in assembling the split mould. Furthermore, it dispenses with a jacket having heretofore been required to insert the mould into a jigger.

Figure 1:
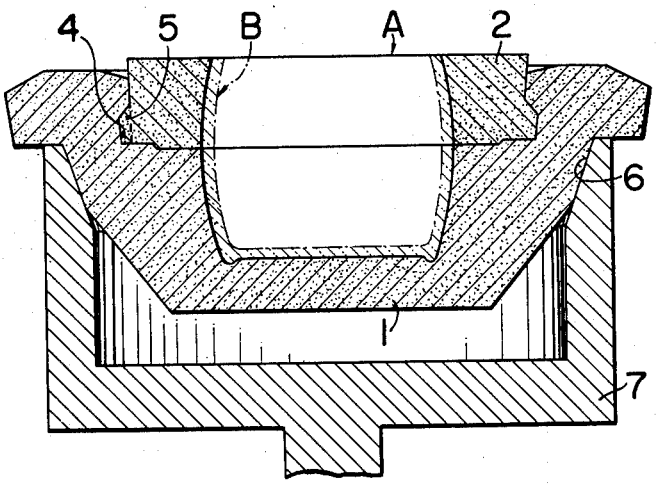
FIG. 1 PRIOR ART
Figure 2:
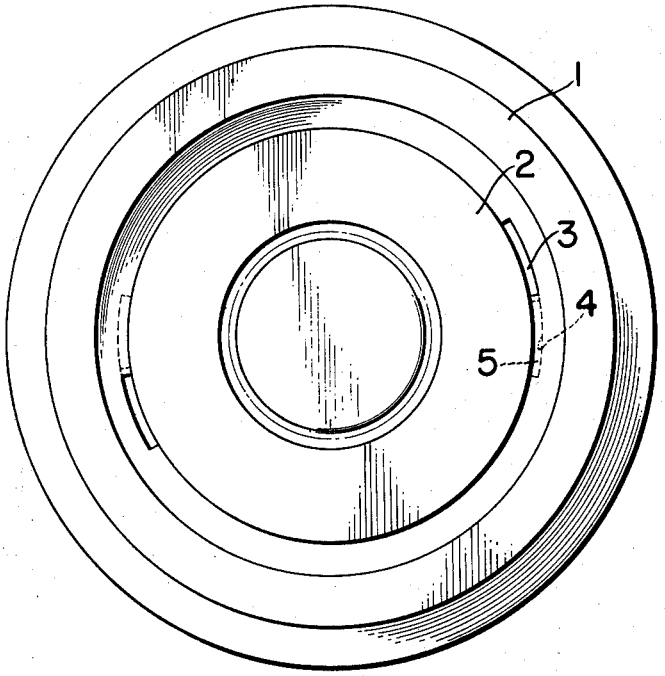
FIG. 2 PRIOR ART
Figure 3:
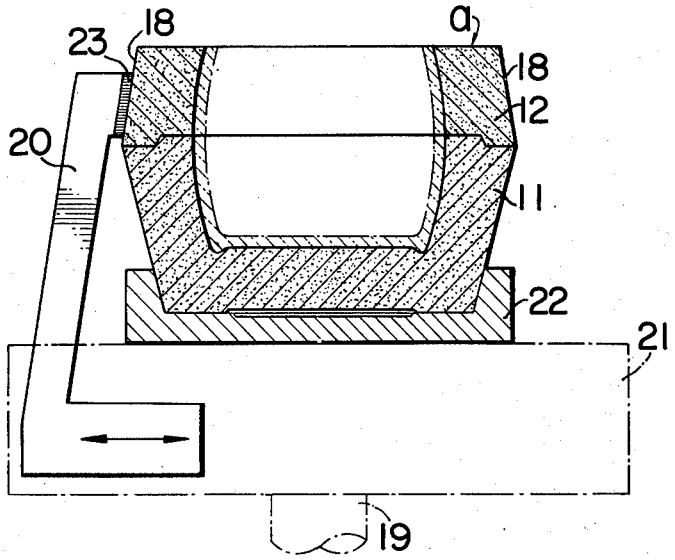
Figure 4:
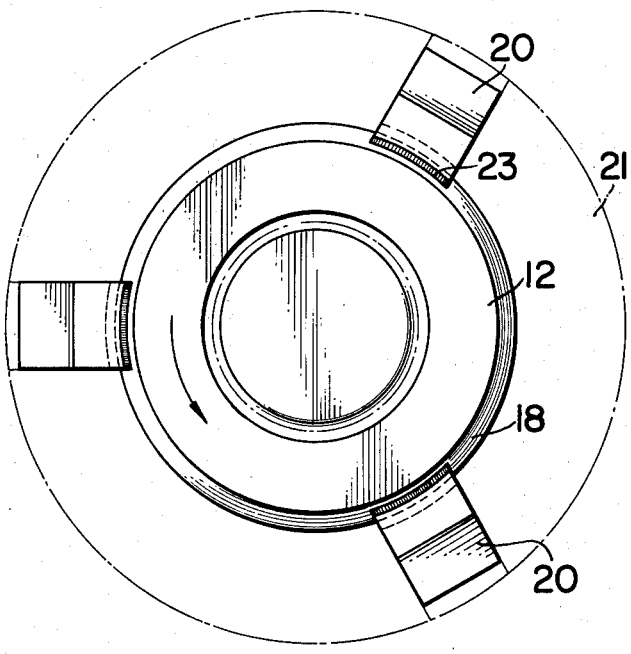

In the accompanying drawings,

FIGS. 1 and 2 are sectional front view and a plan view showing an example of a prior-art apparatus, respectively, while FIGS. 3 and 4 are a sectional front view and a plan view showing an embodiment of an apparatus of the present invention, respectively.

Bellied or undercut hollow wares, such as cups, pots and vases, the moulded article of which may not be taken out without dividing a mould after forming, should be always formed by the use of a split mould. A prior-art forming apparatus using a split mould is shown in FIGS. 1 and 2. In the figures, a split mould A forms a bellied or undercut cup B in such a way that a lower part 1 and an upper part 2 are superposed on each other. The lower part 1 has vertical grooves 3 in the edge of an opening, and a horizontal groove 4 to which the vertical grooves communicate at their lower end parts and which extends in the circumferential direction. The upper mould 2 is provided on the side of the superposed surface with an interlocking mechanism in which bosses 5 fitting with the vertical grooves 3 are formed.

Therefore, in the assemblage of the mould A, the vertical grooves 3 and the bosses 5 are fitted and mated. Subsequently, both the parts 1 and 2 are relatively revolved to move the bosses 5 into the horizontal groove 4. Both the upper and lower parts 1 and 2 are thus assembled. In the forming, a side inclination 6 of the lower part 1 is fittedly mounted on a vacuum suction holder 7 coupled to a shaft of the forming apparatus, and rotation is imparted to the assembly.

With such apparatus, the assemblage of the parts 1 and 2 requires much labor. The construction is complicated, the manufacturing cost is high, and the rate of failure is high. Further, the horizontal groove 4, the bosses 5, etc. have suitable wedge-shaped inclinations in order to bring both the parts 1 and 2 into close contact, and high precision is required to make the inclinations.

In taking out the manufactured article, rotation is first imparted to both the parts 1 and 2 in the circumferential direction. This tends to scratch the surface of the manufactured article, and also may cause deformation.

The present invention makes such forming apparatus simple in handling and rapid in manipulation, and eliminates the various disadvantages in the prior art. It will now be described in detail with reference to FIGS. 3 and 4 of a mould horizontally split into two parts, which is shown as an embodiment.

A split mould *a* consists of a lower mould 11 and an upper mould 12, which is identical to the split mould A in comprising two parts as the lower part 11 and the upper part 12 thereof. The lower mould 11 and the upper mould 12, however, are merely superposed at both the contacting faces, and have no interlocking mechanism therebetween.

The upper mould 12 is formed at the outer periphery with an inclined surface 18 of a frustum of a cone or the like. On the other hand, a chuck 21 having a plurality of claws 20 is attached to a rotary shaft 19 of a forming machine. The claws 20 are constructed such that, when the mould *a* is attached to the chuck 21, they are brought into pressed contact with the inclined surface 18 of the upper part.

Accordingly, the centering of the mould *a* is, of course, performed and the mould *a* may be rigidly secured to the chuck by the claws 20, in such a way that the superposed lower and upper parts 11 and 12 are placed on the chuck 21 through a holder 22 and that all the claws 20 are simultaneously brought towards the center by, e.g., air. The split mould is not restricted to the above one consisting of the two horizontally-divided upper and lower parts, but the object of the present invention may be accomplished with a split mould which consists of more parts or is vertically divided, and which is formed with the inclined surface at its upper part in any case.

According to the present invention, all the claws 20 are pressed on the upper inclined surface 18 of the mould (cushions 23 may be interposed between the claws and said surface) as described above. Thus, the part 12 acts so as to be closely contacted with the part 11, thereby further ensuring the holding of the superposed surfaces and fixing of the mould to the chuck. There is no trouble while operation, the manufacturing expense of the mould is lowered, and the handling is rapid and easy. Since no force is exerted in the circumferential direction of the manufactured article, the disadvantages of deformation, scratches, etc. are also eliminated.

I claim:

1. Apparatus for jigger forming ceramic hollow ware comprising:

a. a two piece split mould having an upper part and a lower part with the upper part being superposed upon the lower part at a line of division having an offset to prevent relative radial displacement but without any longitudinal interlocking therebetween;

b. a chuck to support the mould mounted for rotation and having a holder to receive and hold said lower part, the upper edge of the holder being below said line of division;

c. means to directly hold the mould parts together while also holding the mould against the chuck, said means comprising an inclined surface on the sidewall of the upper mould part inclined toward the center axis of the mould in the form of a truncated cone and a plurality of claws mounted for lineal radial movement in relation to said chuck and extending at an inwardly directed angle from below and radially outwardly of the chuck holder and positioned to bear against the inclined surface in a direction toward the lower mould and said center axis so as to engage or disengage the upper mould part by moving radially inwardly or outwardly, and;

d. means to simultaneously move said plurality of claws in said lineal radial movements.

* * * * *